US008910477B2

(12) United States Patent
Subhash et al.

(10) Patent No.: US 8,910,477 B2
(45) Date of Patent: Dec. 16, 2014

(54) THERMODYNAMIC CYCLE

(76) Inventors: Bhagwat Sunil Subhash, Mumbai (IN); Satpute Satchidanand Ramdasji, Mumbai (IN); Patil Swapnil Shridhar, Greater Noida (IN); Shankar Ravi, Greater Noida (IN)

( * ) Notice: Subject to any disclaimer, the term of this patent is extended or adjusted under 35 U.S.C. 154(b) by 234 days.

(21) Appl. No.: 13/634,270

(22) PCT Filed: Mar. 11, 2011

(86) PCT No.: PCT/IN2011/000169

§ 371 (c)(1),
(2), (4) Date: Sep. 12, 2012

(87) PCT Pub. No.: WO2011/111075

PCT Pub. Date: Sep. 15, 2011

(65) Prior Publication Data

US 2013/0000302 A1 Jan. 3, 2013

(30) Foreign Application Priority Data

Mar. 12, 2010 (IN) ..... 661/MUM/2010

(51) Int. Cl.

| | |
|---|---|
| ***F01K 25/08*** | (2006.01) |
| ***F01K 25/06*** | (2006.01) |
| ***F01K 3/18*** | (2006.01) |
| ***F01K 7/22*** | (2006.01) |

(52) U.S. Cl.

CPC . *F01K 25/06* (2013.01); *F01K 3/18* (2013.01); *F01K 7/22* (2013.01)

USPC ..... 60/651; 60/653; 60/690

(58) Field of Classification Search

USPC ..... 60/651, 653, 671, 690

See application file for complete search history.

(56) References Cited

U.S. PATENT DOCUMENTS 2,471,134 A * 5/1949 Wright ..... 196/111
2,809,925 A * 10/1957 Nelson ..... 203/46

(Continued)

FOREIGN PATENT DOCUMENTS

GB 0786011 11/1957

OTHER PUBLICATIONS

International Searching Authority; PCT/IN2011/000169; Notification of Trans. of the Int. Search Report and the Written Opinion of the Intnl Athty; Aug. 16, 2011.

*Primary Examiner* — Thomas Denion
*Assistant Examiner* — Shafiq Mian
(74) *Attorney, Agent, or Firm* — Harris, Shelton, Hanover & Walsh; Susan B. Fentress

(57) ABSTRACT

A method of improving heat utilization in a thermodynamic cycle, the method comprising heating a working stream in a at least one distillation assembly to produce a rich stream and a lean stream; wherein the distillation assembly comprises a bottom reboiler section, a middle distillation section and a top condenser section; superheating the rich stream in at least one superheater to produce a gaseous working stream; expanding the gaseous working stream in at least one means for expansion to obtain energy in usable form and at least one spent stream; mixing the spent stream and the lean stream to produce a mixed stream; condensing the mixed stream in an absorber-condenser assembly using cooling water to obtain a condensed stream; exchanging heat between the condensed stream and the rich stream to partially condense the rich stream before step b); whereby the condensed stream on heat exchange gives a liquid working stream; exchanging heat between the liquid working stream and the lean stream in at least one heat exchanger before step d) to produce the working stream; and, recycling the working stream to the distillation section of the distillation assembly.

14 Claims, 2 Drawing Sheets

(56) References Cited

U.S. PATENT DOCUMENTS

| | | | | | |
|---|---|---|---|---|---|
| 4,195,485 | A | | 4/1980 | Brinkerhoff | |
| 4,295,335 | A | * | 10/1981 | Brinkerhoff | 60/673 |
| 4,708,721 | A | * | 11/1987 | Ehrler | 95/180 |
| 4,783,210 | A | * | 11/1988 | Ayres et al. | 62/651 |
| 4,819,437 | A | * | 4/1989 | Dayan | 60/673 |
| 5,192,341 | A | * | 3/1993 | Ehrler | 95/189 |
| 5,806,339 | A | * | 9/1998 | Manley | 62/631 |
| 5,839,296 | A | * | 11/1998 | Bonaquist et al. | 62/650 |
| 5,847,189 | A | * | 12/1998 | Tojo et al. | 558/277 |
| 7,393,447 | B2 | * | 7/2008 | Kihara et al. | 205/628 |
| 7,629,485 | B2 | * | 12/2009 | Miyake | 558/274 |

* cited by examiner

THERMODYNAMIC CYCLE

CROSS REFERENCE TO RELATED APPLICATIONS

This application is a §371 National State Application of PCT/IN2011/000169 filed Mar. 11, 1011 which claims priority to IN 661/MUM/2010 filed Mar. 12, 2010.

FIELD OF INVENTION

This invention relates to a system for implementing a thermodynamic cycle. Further the invention relates to a method of improving heat utilization in the thermodynamic cycle.

BACKGROUND AND PRIOR ART

Thermal energy can be usefully converted into mechanical and then electrical form. Methods of converting the thermal energy of low and high temperature heat sources into electric power present an important area of energy generation. Thermal energy from a heat source can be transformed into mechanical and then electrical form using a working stream that is expanded and regenerated in a closed system operating on a thermodynamic cycle. The working fluid can include components of different boiling temperatures, and the composition of the working fluid can be modified at different places within the system to improve the efficiency of energy conversion operation. In any process of converting thermal energy to a usable form, the major loss of available energy in the heat source occurs in the process of boiling or evaporating the working fluid. This loss of available energy known as exergy or energy is due to the mismatch of the enthalpy-temperature characteristics of the heat source and the working fluid in the boiler. Simply put, for any given enthalpy, the temperature of the heat source is always greater than the temperature of the working fluid. The use of a mixture as a working fluid as in the Kalina cycle reduces these losses to a significant extent. Also, the use of low temperature heat sources for heating the working fluid to reduce such losses has been established. However, it would be highly desirable to further reduce these losses in any cycle.

U.S. Pat. No. 4,573,321 discloses power generating cycle which permits the extraction of energy from low temperature heat sources. The vaporous working fluid is withdrawn from the single stage distillation section and expanded in a turbine. The expanded working fluid is condensed in a direct contact condenser or absorber. The separated weak solution from the phase distillation column exchanges heat with the condensed working fluid and is reheated in a regenerator and trim heater. However, it uses heat from an external heat source at the regenerator and the trim heater. Also, the first law efficiency as reported in this patent is as low as 8.5% and second law efficiency is as low as 45%.

U.S. Pat. No. 5,029,444 discloses a thermodynamic cycle utilizing low temperature variable heat source at 110° C. to 77° C. The spent stream formed after the expansion of gaseous working stream is mixed with the lean stream to form pre-condensed stream. The pre-condensed stream is further condensed to produce a liquid working stream. The liquid working stream is then partially evaporated, utilizing heat of the spent stream and the lean stream. After phase separations, liquid stream is mixed with the vapor stream from reboiler to produce the enriched stream. This stream is in state of vapor-liquid mixture that is then heated with heat source to form gaseous working stream. The gaseous working stream is then expanded in expander to produce the usable form of energy.

However, the patent reports second law efficiency of only 49.66%. Here, the system is operated at a very low pressure and less pressure ratio for isentropic operation in turbine, which results in low power output and inefficient heat integration.

Accordingly, a need exists for a thermodynamic cycle which can increase the efficiency, improve the heat utilization in the cycle by best possible heat integration that would result in much better heat recovery.

SUMMARY

The present invention relates to a method of improving the heat utilization in the thermodynamic cycle; thereby providing a thermodynamic cycle having high efficiency.

In accordance with an embodiment of the invention, a working stream is heated in at least one distillation assembly, producing a rich stream and a lean stream. The rich stream is partially condensed in the condenser section of the distillation assembly and the remaining stream is sent to at least one superheater for superheating. A gaseous working stream is produced which on expanding in at least one means for expansion produces at least one spent stream. The spent stream is mixed with the lean stream to produce a mixed stream and the mixed stream is further condensed in an absorber-condenser assembly to obtain a condensed stream. The condensed stream exchanges heat with the rich stream in the condenser section of the distillation assembly. On heat exchange, the condensed stream produces a liquid working stream which exchanges heat with the lean stream before the lean stream mixes with the spent stream. On heat exchange, the liquid working stream gives the working stream which is recycled to the distillation assembly.

The present invention further relates to a system for implementing a thermodynamic cycle comprising at least one distillation assembly for heating a working stream to obtain a rich stream and a lean stream, at least one super heater for super heating the rich stream to form a gaseous working stream, at least one means for expanding the gaseous working stream to obtain energy in usable form and a spent stream, an absorber-condenser assembly for mixing the lean stream and the spent stream and condensing the mixed stream to obtain a condensed stream; wherein the condensed stream exchanges heat in the distillation assembly to obtain a liquid working stream; at least one heat exchanger for exchanging heat between the lean stream and the liquid working stream; wherein the distillation assembly, the superheater, the means for expanding, the absorber-condenser assembly and the heat exchanger are operatively linked to each other.

BRIEF DESCRIPTION OF DRAWINGS

For a more complete understanding of the invention, reference should now be made to the embodiments illustrated in greater detail in the accompanying drawings and described below by way of examples of the invention.

DETAILED DESCRIPTION OF THE INVENTION

Figure 1:
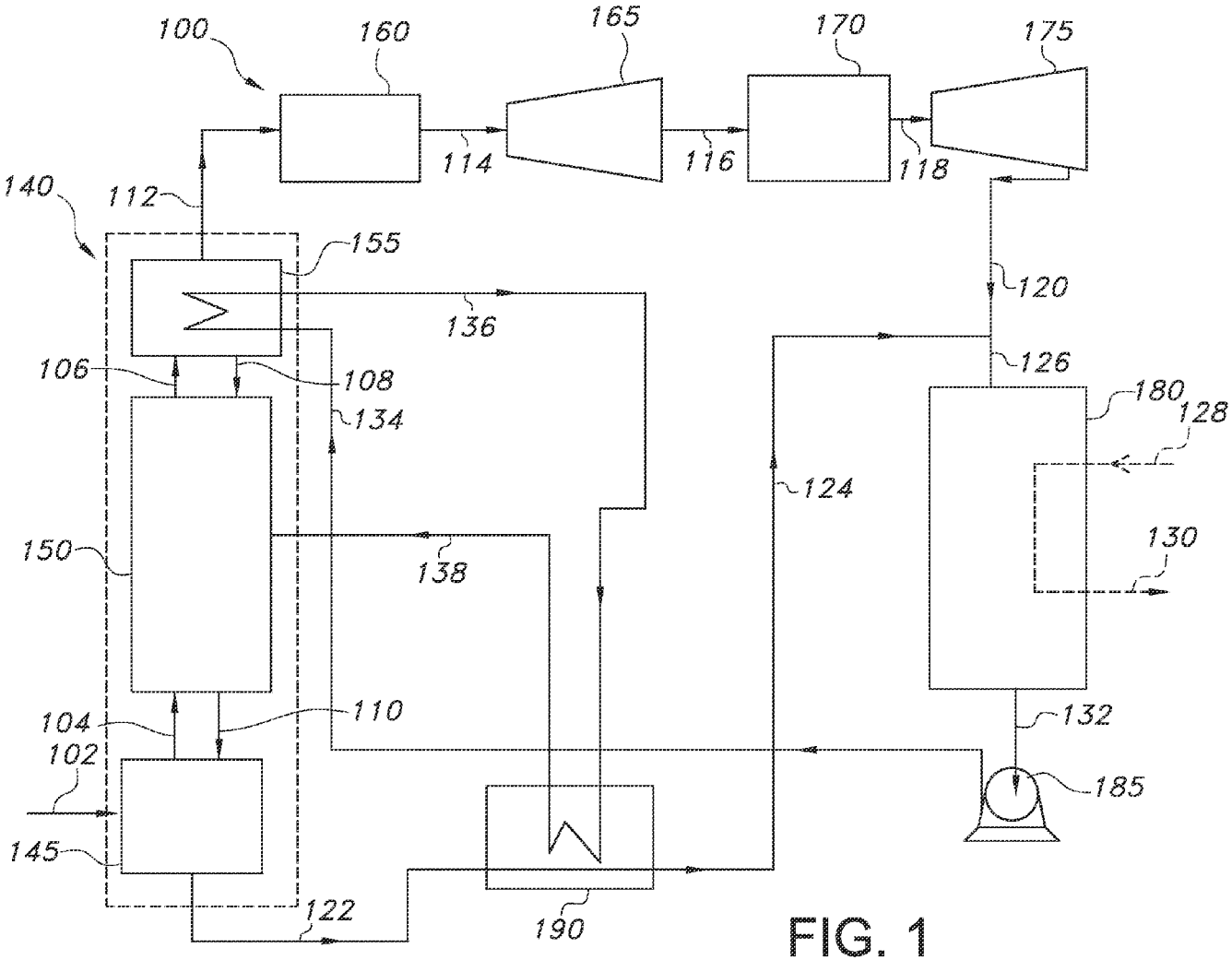
FIG. 1 gives a schematic representation of a system for implementing a thermodynamic cycle

For a better understanding of the present invention, reference will be made to the following detailed description of the invention which is to be read in association with the accompanying drawings.

In describing the embodiment of the invention which is illustrated in the drawings, specific terminology is resorted to for the sake of clarity. However, it is not intended that the invention be limited to the specific terms so selected and it is to be understood that each specific term includes all technical equivalents that operate in a similar manner to accomplish a similar purpose.

The present invention relates to a thermodynamic cycle that achieves high efficiency in transforming energy from low temperature heat source into usable energy using a multi-component working fluid.

Particularly this invention relates to method of improving the heat utilization in a thermodynamic cycle with best possible heat integration that results in greater heat recovery.

In greater detail, the subject invention is directed to a higher efficiency regenerative thermodynamic cycle comprising at least one distillation assembly, at least one super-heater, at least one means for expansion, an absorber condenser assembly and at least one heat exchanger. Further, the invention is also directed to a method of implementing the thermodynamic cycle.

According to an embodiment of the invention, the means for expansion is selected from a turbine and an engine.

According to a preferred embodiment of the invention, the means for expansion selected is a turbine.

According to an embodiment of the invention, a working stream is heated in the distillation assembly using a suitable heat source.

According to another embodiment of the invention, the working stream is a multi-component working stream that comprises a low boiling component and high boiling component. In general, the working stream may be mixtures of any number of compounds with favorable thermodynamic characteristics and solubility.

According to yet another embodiment of the invention, the working stream is selected from a group consisting of an ammonia-water mixture with/without suitable additives, water-lithium bromide mixture with/without suitable additives, two or more hydrocarbons, two or more freons, mixtures of hydrocarbons and freons. Suitable additives which may be added to the multi-component working stream may be known to a person skilled in the art.

According to a preferred embodiment of the invention, mixtures of ammonia-water and water-lithium bromide mixture with/without suitable additives are used as working stream.

According to a preferred embodiment, a mixture of water and ammonia is used as the working stream.

According to an embodiment of the invention, the heat source is a low temperature heat source which gives out latent heat of condensation for heating the working stream.

According to an embodiment of the invention as shown in FIG. 1, a system for implementing a thermodynamic cycle (100) has a distillation assembly (140), a first turbine stage (165), a second turbine stage (175) and an absorber-condenser assembly (180), a first super-heater (160) between the distillation assembly (140) and the first turbine stage (165), a second super-heater (170) between the first turbine stage (165) and the second turbine stage (175) and a heat exchanger (190) between the absorber-condenser assembly (180) and the distillation assembly (140), all operatively connected to each other.

The distillation assembly (140) comprises of a bottom reboiler section (145), a middle distillation section (150) and a top condenser section (155). The bottom reboiler section (145) of distillation assembly is provided with a low temperature heat source (102).

The middle distillation section (150) of distillation assembly (140) consists of multiple stages equivalent to use of multiple distillations, which results in reduction of heat requirement for achievement of desired pressure and quality of vapors out from the system which improves the overall efficiency. The condenser (155) of the distillation assembly (140), operating at a higher temperature uses process stream as cooling media, thereby partially condensing the rich stream before it is superheated in the superheater.

The low boiling component of the working stream is vaporized by the heat provided by the low temperature heat source (102) and is separated from the high boiling component in the distillation section (150) of the distillation assembly (140). The vaporized low boiling component is then passed to the top condenser section (155) of distillation assembly (140), wherein the vapors of low boiling component are partially condensed and are returned to the middle distillation section (150) of the distillation assembly (140). The remnant vapors of the low boiling component exit from the condenser (155) of the distillation assembly (140) as a rich stream (112). The high boiling component of the working stream is removed from the bottom reboiler section (145) of the distillation assembly as lean stream (122).

According to a further embodiment, the distillation assembly used in the present invention is a multi-stage distillation assembly. Use of a multi-stage assembly gives reduction of about 10-40% in heat input load as compared to a single stage distillation and hence results in improvement in efficiency.

The rich stream (112) from the distillation assembly (140) is sent to the first super-heater (160) for superheating the rich stream (112) to obtain a first gaseous working stream (114).

The first gaseous working stream (114) from the first super-heater (160) is expanded in the first turbine stage (165) to provide a first spent stream (116). The first spent stream (116) obtained is heated in the second super-heater (170) to provide a second gaseous working stream (118). The second gaseous working stream (118) is then expanded in the second turbine stage (175) to obtain a second spent stream (120). The second spent stream (120) which is at low temperature and pressure is fed to the absorber-condenser assembly (180).

The lean stream (122) from the distillation assembly (140) after exchanging heat in the heat exchanger (190) gives heat exchanged stream (124) which is mixed with the second spent stream (120) to obtain mixed stream (126).

According to an embodiment of the invention, the heat exchanged stream (124) is mixed with the spent stream (120) in the absorber-condenser assembly (180).

According to an alternate embodiment of the invention, the heat exchanged stream (124) is mixed with the spent stream externally using a suitable means for mixing (not shown in the figure). The means for mixing is selected from mixer, spray-nozzle, venturi or any other gas-liquid contact device.

The mixed stream (126) is condensed in the absorber-condenser assembly (180) and a condensed stream (132) is provided. The absorber-condenser assembly (180) is provided with cooling water inlet (128) which on heat exchange with the mixed stream in the absorber-condenser assembly leaves the assembly as cooling water outlet (130).

According to an embodiment of the invention, the absorber-condenser assembly of the present invention works in a different manner as compared to the normal condensers used in normal cycles. Here, condensation occurs over a range of temperatures than at a constant temperature i.e. outlet stream from the absorber-condenser assembly is at a temperature less than the outlet cooling water temperature. This enables use of lower temperature at downstream of turbine and hence improves power output, further enhancing efficiency. Variable temperature condensation in absorber-condenser also results in reduction of cooling water requirement compared to constant temperature condensation.

In FIG. 1, the condensed stream (132) from the absorber-condenser assembly is then pumped to higher pressure with the help of a pump (185) to form pressurized condensed stream (134) and is sent to the top condenser section (155) of the distillation assembly wherein the pressurized condensed stream (134) exchanges heat with the vapors of the rich stream and partially condenses the rich stream. The liquid working stream (136) is then sent to the heat exchanger (190) wherein heat exchange takes place between the liquid working stream (136) and the lean stream (122) to provide working stream (138). The working stream (138) is then recycled to the distillation section (150) of the distillation assembly, thereby completing the thermodynamic cycle.

Figure 2:
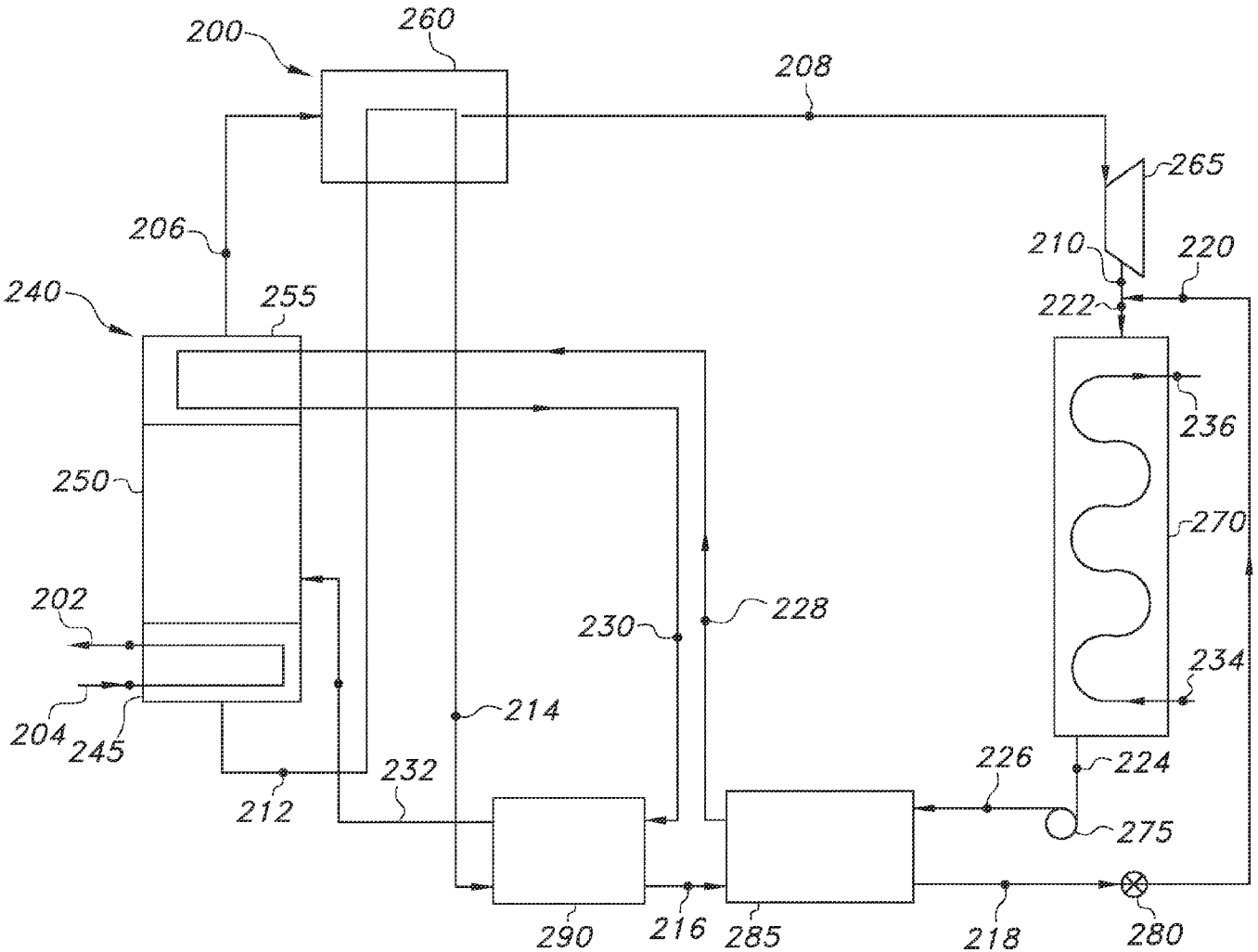
FIG. 2 shows a schematic representation of a system for implementing a thermodynamic cycle in accordance with a preferred embodiment of the invention It is to be understood that the drawing is not to scale and is schematic in nature. In certain instances, details which are not necessary for an understanding of the present invention or which renders other details difficult to perceive, may be omitted. It should be understood, of course, that the invention is not necessarily limited to the particular embodiments illustrated herein.

According to a preferred embodiment of the invention as shown in FIG. 2, a system for implementing a thermodynamic cycle (200) comprises a distillation assembly (240), a turbine (265) and an absorber-condenser assembly (270), a super-heater (260) between the distillation assembly (240) and the turbine (265), a first heat exchanger (290) and a second heat exchanger (285) between the absorber-condenser assembly (270) and the distillation assembly (240). The second heat exchanger (285) is placed between the absorber-condenser assembly (270) and the first heat exchanger (290), and the first heat exchanger (290) is placed between the second heat exchanger (285) and the distillation assembly (240), all of which are operatively connected to each other.

The distillation assembly (240) comprises of a bottom reboiler section (245), a middle distillation section (250) and a top condenser section (255). The bottom reboiler section (245) of distillation assembly is provided with an external heat source (202); the external heat source (202) gives out latent heat of condensation for heating the working stream. The middle distillation section (250) of the distillation assembly (240) consists of multiple stages, equivalent to use of multiple distillations, which results in reduction of heat requirement for achievement of desired pressure and quality of vapors from the system, which improves the overall efficiency. The top condenser section (255) of the distillation assembly (240), operating at a higher temperature uses process steam as cooling media, thereby partially condensing the rich stream (206) before it is superheated in the super-heater (260).

According to yet another embodiment of the invention, the lean stream (212) from the distillation assembly (240) is sent to the super-heater (260); wherein it exchanges heat with the rich stream (206) to obtain a heat exchanged lean stream (214). The rich stream is sent out of the superheater (260) as a gaseous working stream (208).

This utilization of heat of the hot lean stream from the reboiler of the distillation assembly in at least one superheater as in the present invention, leads to effective heat utilization, adding to the overall efficiency.

Further, the gaseous working stream (208) from the super-heater (260) is expanded in the turbine (265) to provide spent stream (210).

The heat exchanged lean stream (214) from the super-heater (260), then exchanges heat in a first heat exchanger (290) to obtain a first heat exchanged stream (216) which exchanges heat in a second heat exchanger (285) to obtain a second heat exchanged stream (218). The second heat exchanged stream (218) is throttled to low pressure to obtain a low pressure stream (220). This low pressure stream (220) is mixed with spent stream (210) to obtain a mixed stream (222).

According to an embodiment of the invention, the spent stream (210) and the low pressure stream (220) are mixed in the absorber-condenser assembly (270).

According to an alternate embodiment of the invention, the spent stream (210) and the low pressure stream (220) are mixed outside the absorber-condenser assembly in a suitable means for mixing (not shown in the figure). The means for mixing is selected from mixer, spray-nozzle, venture or any other gas-liquid contact device.

The mixed stream (222) is then condensed in the absorber-condenser assembly (270) to obtain a condensed stream (224) which is then pumped and sent to the first heat exchanger wherein on heat exchange a third heat exchanged stream (228) is formed. The third heat exchanged stream (228) is sent to the top condenser section (255) of distillation assembly (240) wherein, it exchanges heat with the third heat exchanged stream (228), thereby partially condensing the rich stream before it is superheated in the super-heater (260). The third heat exchanged stream (228) after exchanging heat in the distillation assembly (240) comes out as a liquid working stream (230).

Further, the liquid working stream (230) is sent to the heat exchanger (290) wherein heat exchange takes place between the liquid working stream (230) and the heat exchanged lean stream (214) to provide a working stream (232). The working stream (232) is then recycled to the middle distillation section (250) of the distillation assembly (240), thereby completing the thermodynamic cycle.

EXAMPLES

Convenient parameters for the streams set forth in FIG. 2 are presented in Table 1 for a system having water-ammonia enriched working media. The power output of the turbine for the proposed invention is 5 kW.

TABLE 1

Parameters for the streams in FIG. 2

| | | | Mole fraction | | Flowrate, kmol/h | | Enthalpy, kcal/kmol | |
|---|---|---|---|---|---|---|---|---|
| Stream | Temp, K | Pressure, atm | X | Y | liquid | vapour | liquid | vapour |
| 206 | 349.47 | 18 | | 0.99 | | 4.25 | | 5695.2 |
| 208 | 368.15 | 18 | | 0.99 | | 4.25 | | 5908.4 |
| 210 | 270.55 | 3 | 0.78 | 0.9998 | 0.19 | 4.06 | −678.4 | 5153.6 |

TABLE 1-continued

Parameters for the streams in FIG. 2

| Stream | Temp, K | Pressure, atm | Mole fraction X | Mole fraction Y | Flowrate, kmol/h liquid | Flowrate, kmol/h vapour | Enthalpy, kcal/kmol liquid | Enthalpy, kcal/kmol vapour |
|---|---|---|---|---|---|---|---|---|
| 226 | 297.15 | 18 | 0.5083 | | 41.85 | | −556.2 | |
| 228 | 342 | 18 | 0.5083 | | 41.85 | | 156.3 | |
| 230 | 343.96 | 18 | 0.5083 | | 41.85 | | 191.4 | |
| 232 | 363.44 | 18 | 0.5083 | | 41.85 | | 586.9 | |
| 212 | 371.15 | 18 | 0.4538 | | 37.61 | | 763.2 | |
| 214 | 370.11 | 18 | 0.4538 | | 37.61 | | 739.2 | |
| 216 | 349.47 | 18 | 0.4538 | | 37.61 | | 298.9 | |
| 218 | 300.15 | 18 | 0.4538 | | 37.61 | | −493.9 | |
| 220 | 300.15 | 3 | 0.4538 | | 37.61 | | −493.9 | |
| 202 | 374.15 | 1.04 | 0 | | 3.07 | | 11512 | |
| 204 | 374.15 | 1.04 | 0 | | 3.07 | | 1820.3 | |
| 234 | 294.15 | — | 0 | | 283 | | 378 | |
| 236 | 299.15 | — | 0 | | 283 | | 468 | |

The theoretical performance of the system of the present invention, using parameters of Table 1 according to an embodiment as shown in FIG. 2, is included in Table 2.

TABLE 2

Heat Loads and Efficiencies

| Equipment | Heat Load, kcal/hr |
|---|---|
| 245, bottom | 29799 |
| 255, top | 1468 |
| 260 | 905 |
| 290 | 16556 |
| 285 | 29818 |
| 270 | 25499 |
| First Law efficiency | 14.43% |
| Carnot efficiency | 19.94% |
| Second Law efficiency | 72.37% |

According to various embodiments of the present invention, different modes of heat recovery are employed in the system such as the partial condenser providing some heat for the working stream to be fed to the distillation assembly, effective heat exchange between the lean stream and the condensed stream and the operational temperature of the absorber-condenser assembly; all of which contribute to high second law efficiency in the thermodynamic cycle.

As can be seen from the table above, a second law efficiency of as high as 72.37% is obtained by the method of the preferred embodiment of the invention.

While the present invention has been described with respect to a number of preferred embodiments, which utilize a single preferred external heat source, those skilled in the art will appreciate a number of variations and modifications of those embodiments. For example, a different external heat source may be used, the number of heat exchangers may be increased or decreased, the number of pumps, means for expansion, condensing devices, distillation columns, etc., may be varied, as well as the number and composition of streams flowing through the cycle. Thus, it is intended that the appended claims cover all such variations and modifications as fall within the true spirit and scope of the present invention.

We claim:

1. A method of improving heat utilization in a thermodynamic cycle, the method comprising:

a) heating a working stream in a at least one distillation assembly to produce a rich stream and a lean stream; wherein the distillation assembly comprises a bottom reboiler section, a middle distillation section and a top condenser section;

b) superheating the rich stream in at least one superheater to produce a gaseous working stream;

c) expanding the gaseous working stream in at least one means for expansion to obtain energy in usable form and at least one spent stream;

d) mixing the spent stream and the lean stream to produce a mixed stream;

e) condensing the mixed stream in an absorber-condenser assembly using cooling water to obtain a condensed stream;

f) exchanging heat between the condensed stream and the rich stream to partially condense the rich stream before step b); whereby the condensed stream on heat exchange gives a liquid working stream;

g) exchanging heat between the liquid working stream and the lean stream in at least one heat exchanger before step d) to produce the working stream; and, h) recycling the working stream to the distillation section of the distillation assembly.

2. The method as claimed in claim 1, wherein step e) further comprises operating the absorber-condenser assembly at a temperature less than that of outlet temperature of the cooling water provided to the absorber-condenser assembly.

3. The method as claimed in claim 1, wherein step e) further comprises operating the absorber-condenser assembly at a temperature equal to that of outlet temperature of the cooling water provided to the absorber-condenser assembly.

4. The method as claimed in claim 1, wherein step f) further comprises exchanging heat between the condensed stream and the rich stream in the top condenser section of the distillation assembly.

5. The method as claimed in claim 1, wherein step b) further comprises recovering heat from the lean stream obtained from the bottom of the reboiler section of the distillation assembly for superheating the rich stream in at least one superheater, whereby the lean stream on heat exchange produces a heat exchanged lean stream.

6. The method as claimed in claim 5, wherein step g) further comprises exchanging heat between the liquid working stream and the heat exchanged lean stream in the at least one heat exchanger.

7. The method as claimed in claim 6, wherein step g) further comprises exchanging heat between the liquid working stream and the lean stream in two heat exchangers.

8. A system for implementing a thermodynamic cycle, the system comprising:

a) at least one distillation assembly for heating a working stream to obtain a rich stream and a lean stream;

b) at least one super heater for super heating the rich stream to form a gaseous working stream;

c) at least one means for expanding the gaseous working stream to obtain energy in usable form and a spent stream;

d) an absorber-condenser assembly for mixing the lean stream and the spent stream and condensing the mixed stream to obtain a condensed stream; wherein the condensed stream exchanges heat in the distillation assembly to obtain a liquid working stream; and, e) at least one heat exchanger for exchanging heat between the lean stream and the liquid working stream; wherein the distillation assembly, the superheater, the means for expanding, the absorber-condenser assembly and the heat exchanger are operatively linked to each other.

9. The system as claimed in claim 8, wherein the distillation assembly comprises a bottom reboiler section, a middle distillation section and a top condenser section.

10. The system as claimed in claim 9, wherein a low grade heat source is provided to the bottom reboiler section of the distillation-assembly for heating the working stream.

11. The system as claimed in claim 8, further comprising at least one pump for pressurizing the condensed stream, wherein the pump is placed downstream of the absorber-condenser assembly.

12. The system as claimed in claim 8, further optionally comprising a means for mixing selected from a mixer, spray-nozzle, venturi and a gas-liquid contact device, wherein the means for mixing is placed upstream of the absorber-condenser assembly.

13. The system as claimed in claim 8, wherein the working stream is selected from a group consisting of an ammonia-water mixture with/without suitable additives, water-lithium bromide mixture with/without suitable additives, two or more hydrocarbons, two or more freons and mixtures of hydrocarbons and freons.

14. The system as claimed in claim 13, wherein the working stream is selected from ammonia-water mixture with/without suitable additives and water-lithium bromide mixture with/without suitable additives.

* * * * *